US006229449B1

(12) United States Patent
Kirchner et al.

(10) Patent No.: US 6,229,449 B1
(45) Date of Patent: May 8, 2001

(54) DETECTOR APPARATUS

(76) Inventors: Darren S. Kirchner; Judith E. Kirchner, both of 1450 S. Chatham; Richard A. Kirchner, 615 Johnson St., all of Janesville, WI (US) 53545

( * ) Notice: Subject to any disclaimer, the term of this patent is extended or adjusted under 35 U.S.C. 154(b) by 0 days.

(21) Appl. No.: 09/301,916

(22) Filed: Apr. 29, 1999

(51) Int. Cl.[7] ..... G08B 17/10
(52) U.S. Cl. ..... 340/628; 340/532; 340/539
(58) Field of Search ..... 340/628, 517, 340/523, 531, 532, 539

(56) References Cited

U.S. PATENT DOCUMENTS

| | | | | |
|---|---|---|---|---|
| 4,160,246 | | 7/1979 | Martin et al. . | |
| 4,260,983 | | 4/1981 | Falck et al. . | |
| 4,481,502 | * | 11/1984 | Dawson | 340/516 |
| 4,514,731 | | 4/1985 | Falck et al. . | |
| 4,517,555 | | 5/1985 | Marsocci et al. . | |
| 4,556,873 | | 12/1985 | Yamada et al. . | |
| 5,227,776 | * | 7/1993 | Starefoss | 340/825.36 |
| 5,627,515 | | 5/1997 | Anderson . | |

* cited by examiner

*Primary Examiner*—Edward Lefkowitz

(74) *Attorney, Agent, or Firm*—David J. Archer

(57) ABSTRACT

A detector apparatus is disclosed for emitting a warning alarm signal in response to the presence of a hazardous condition within at least one room of a building having a plurality of rooms. The apparatus includes a plurality of hazardous condition detectors arranged such that at least one detector is disposed within each of the rooms. Each of the detectors includes a detecting device for detecting the presence of the hazardous condition and a micro controller electrically connected to the detecting device and powered by an electrical power source. An alarm is electrically connected to the controller such that when the detecting device detects the presence of the hazardous condition, the controller emits an electrical signal. An analog to digital converter device is electrically connected to the controller for converting the electrical signal into a digital signal so that when the hazardous condition is detected, the converter transmits the digital signal. A receiver is provided for receiving the digital signal. The receiver includes an antenna for receiving the digital signal and a crystal for detecting the digital signal and for using the detected digital signal to activate the alarm. The arrangement is such that the alarm emits the warning alarm signal. Each of the detectors of the plurality of detectors is disposed remote relative to each other within each of the rooms of the building such that when a hazardous condition is detected by one of the detectors, all of the detectors emit warning alarm signals for warning occupants within any of the rooms of a potential hazard within at least one of the rooms.

16 Claims, 3 Drawing Sheets

DETECTOR APPARATUS

BACKGROUND OF THE INVENTION

1. Field of the Invention

The present invention relates to a detector apparatus. More particularly, the present invention relates to a detector apparatus for emitting a warning alarm signal in response to the presence of a hazardous condition within at least one room of a building having a plurality of rooms.

2. Information Disclosure Statement

Smoke detectors and the like are provided in buildings such as private dwellings and offices in order to warn occupants of a potential fire hazard. Such fire and smoke detectors include a photoelectric cell which includes an emitter for emitting a beam of light and a receiver for receiving the beam. The detector is sensitive to smoke so that the beam of light is scattered by the presence of smoke. Consequently, when the beam of light is not received by the receiver, the receiver transmits a warning signal for warning the occupants of the potential danger.

Prior art smoke detectors have typically required a considerable power supply in order to reliably run such detectors for several months. Consequently, because of the power drain, it has been necessary to check and replace batteries every few months. However, a detector is not always placed in a readily accessible location. Therefore, there has existed a tendency to postpone the testing and replacement of a discharged battery. Clearly, such failure to maintain adequately charged batteries has led to fire detector failures thus causing several fire and smoke inhalation fatalities.

Therefore, many authorities have passed legislation requiring all new dwellings to be hard wired for fire detectors rather than relying on battery operated devices. More specifically, the Federal Fire and Electrical Code requires all newly constructed buildings whether industrial, commercial or residential to have such smoke alarms hardwired.

However, there is no requirement for pre-existing buildings built before 1984 to be hardwired for smoke detectors. Nevertheless, in the interests of safety, many owners of older buildings built prior to 1984 would like to have the safety factors associated with a hardwired system but without the considerable expense or inconvenience of providing a hidden wiring system. Also, the alternative of having unsightly wires trailing across walls and ceilings is unacceptable.

The present invention overcomes the problems associated with the prior art arrangements by providing a detector apparatus which is battery operated but which uses a fraction of the electrical power used by prior art devices and thus conserves the power source for a considerable period so that frequent battery changes are avoided.

Therefore, it is a primary feature of the present invention to provide a a hazardous condition detector apparatus which overcomes the problems associated with prior art detectors and which makes a considerable contribution to the art of fire detection.

Another feature of the present invention is the provision of a hazardous condition detector apparatus which is battery operated and which maximizes the conservation of the power source.

A further feature of the present invention is the provision of a hazardous condition detector apparatus which activates all the hazardous condition detectors throughout a building when a hazardous condition is detected by at least one of the detectors so that occupants in the rest of the building are warned of the potential fire or other hazard in another part of the building.

Other features and advantages of the present invention will be readily apparent to those skilled in the art by a careful consideration of the detailed description of a preferred embodiment of the present invention described hereinafter.

SUMMARY OF THE INVENTION

A detector apparatus is provided according to the present invention for emitting a warning alarm signal in response to the presence of a hazardous condition within at least one room of a building having a plurality of rooms. The apparatus includes a plurality of hazardous condition detectors arranged such that at least one detector is disposed within each of the rooms. Each of the detectors includes a detecting device for detecting the presence of a hazardous condition and a micro controller electrically connected to the detecting device and powered by an electrical power source. An alarm is electrically connected to the controller such that when the detecting device detects the presence of a hazardous condition, the controller emits an electrical signal. An analog to digital converter device is electrically connected to the controller for converting the electrical signal into a digital signal so that when a hazardous condition is detected, the converter transmits the digital signal. A receiver is provided for receiving the digital signal, the receiver including an antenna for receiving the digital signal and a crystal for detecting the digital signal and for using the detected digital signal to activate the alarm.

The arrangement is such that each detector of the plurality of detectors is disposed remote relative to each other within a respective room of the building so that when a hazardous condition is detected by one of the detectors, all of the detectors emit warning alarm signals for warning occupants within any of the rooms of a potential hazard within at least one of the rooms.

In a more specific embodiment of the present invention, the detecting device includes a radiation source for emitting a radiation beam having an optical axis and a photodetector for receiving such beam. When a hazardous condition is present, the radiation beam is scattered by the smoke particles or the like thus triggering the photodetector to emit a warning signal.

Furthermore, the micro controller includes an encoder for encoding pulses emitted by the detecting device and a decoder for analyzing the pulses and for generating the electrical signal when a hazardous condition is detected by the detecting device.

Additionally, the controller further includes an activating circuit for activating the controller only when the detecting device detects a hazardous condition so that in the absence of a hazardous condition, energy consumption and power drain from the source of power is minimized.

More specifically, the electrical power source is a direct current source which is preferably a 9 volt battery.

The alarm includes an audible warning device for emitting an audible warning signal. However, in an alternative embodiment of the present invention, the alarm includes a visual warning device for emitting a visual warning signal.

The digital signal is easily transmitted over a considerable distance within the building while minimizing a power drain from the source of electrical power.

Also, the detector apparatus further includes an amplifier for amplifying the digital signal and a transmitter connected to the analog to digital converter and to the controller for transmitting the digital signal.

Additionally, the receiver further includes an amplifying circuit for amplifying the detected digital signal and for applying the amplified digital signal to the warning alarm.

Moreover, each of the detectors includes a discriminator circuit for determining which detector of the plurality of detectors is detecting the presence of a hazardous condition so that location of the source of the potential hazard is facilitated.

Furthermore, each of the detectors is free of any need for electrical hardwired connections to another detector of the plurality of detectors.

Also, each of the detectors is free of any requirement of connection to an electrical outlet of a source of mains power within the building thereby avoiding the need for locating each detector close to an electrical power outlet.

Many modifications and variations of the present invention will be readily apparent to those skilled in the art of fire detection by a careful consideration of the detailed description of a preferred embodiment of the present invention described herein. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
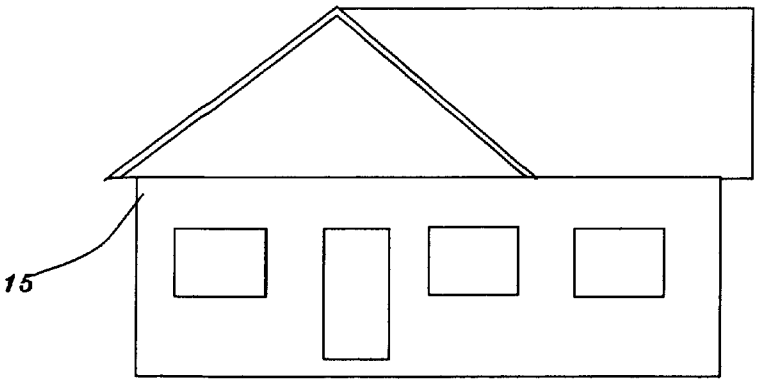
FIG. 1 is a front elevational view of a building having a detector apparatus according to the present invention.

FIG. 1 is a front elevational view of a building 15 having a detector apparatus generally designated 10 according to the present invention.

Figure 2:
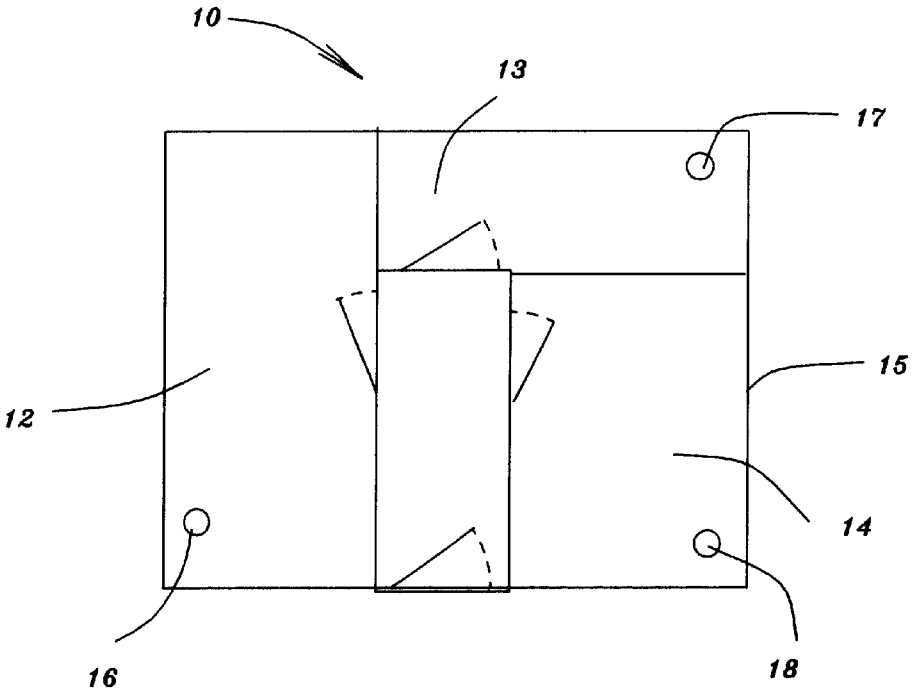
FIG. 2 is a plan view of the building shown in FIG. 1 including the detector apparatus according to the present invention.

FIG. 2 is a plan view of the building 15 shown in FIG. 1. As shown in FIG. 2, the apparatus 10 emits a warning alarm signal in response to the presence of a hazardous condition within at least one room for example room 12 of the building 15 having a plurality of rooms 12, 13 and 14. The apparatus 10 includes a plurality of hazardous condition detectors 16, 17 and 18 arranged such that at least one detector 16 is disposed within a respective room, for example the room 12.

Figure 3:
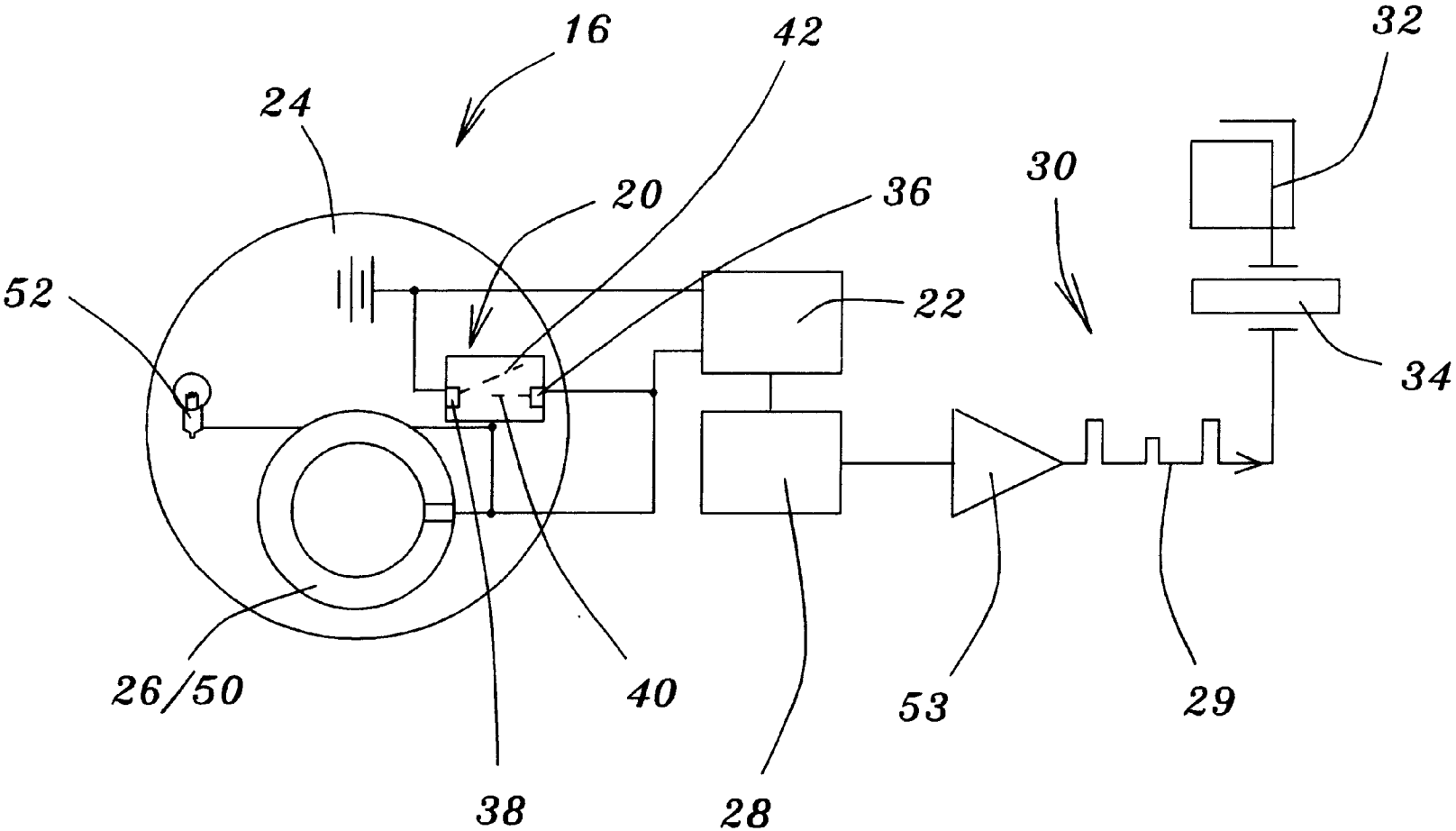
FIG. 3 is a schematic view of one of the detectors shown in FIG. 2.

FIG. 3 is a schematic view of one of the detectors 16. As shown in FIG. 3, the detector 16 includes a detecting device generally designated 20 for detecting the presence of a hazardous condition and a micro controller generally designated 22 electrically connected to the detecting device 20 and powered by an electrical power source 24. The micro controller 22 may for example be a surface mount type controller such as a controller manufactured by PIC Microchip and designated PIC 16C55Y having a maximum frequency of 4 Mhz. An alarm 26 is electrically connected to the controller 22 such that when the detecting device 20 detects the presence of a hazardous condition, the controller 22 emits an electrical signal. An analog to digital converter device 28 is electrically connected to the controller 22 for converting the electrical signal into a digital signal 29 so that when a hazardous condition is detected, the converter 28 transmits the digital signal 29. The converter device 28 may be a DAC0800LCM having a maximum frequency of 4 Mhz. A receiver generally designated 30 is provided for receiving the digital signal 29, the receiver 30 or a combined transmitter/receiver includes a surface mount antenna 32 for receiving the digital signal and a surface mount type crystal 34 such as a 4 Mhz XC587CT for detecting the digital signal and for using the detected digital signal to activate the alarm 26. The micro controller 22 and converter 28 could be a combined device such as a AT90LS4433 manufactured by Atmel Inc.

The arrangement is such that each of the detectors 16, 17 and 18 of the plurality of detectors 16–18 is disposed remote relative to each other within a respective room of the building 15 so that when a hazardous condition is detected by one of the detectors, all of the detectors 16–18 emit warning alarm signals for warning occupants within any of the rooms 12–14 of a potential hazard within at least one of the rooms.

In a more specific embodiment of the present invention, the detecting device 20 includes a radiation source 36 having an optical axis 40 and a photodetector 38. The axis 40 intersects a further axis 42 of the photodetector 38 for detecting radiation scattered by smoke particles or the like.

Figure 4:
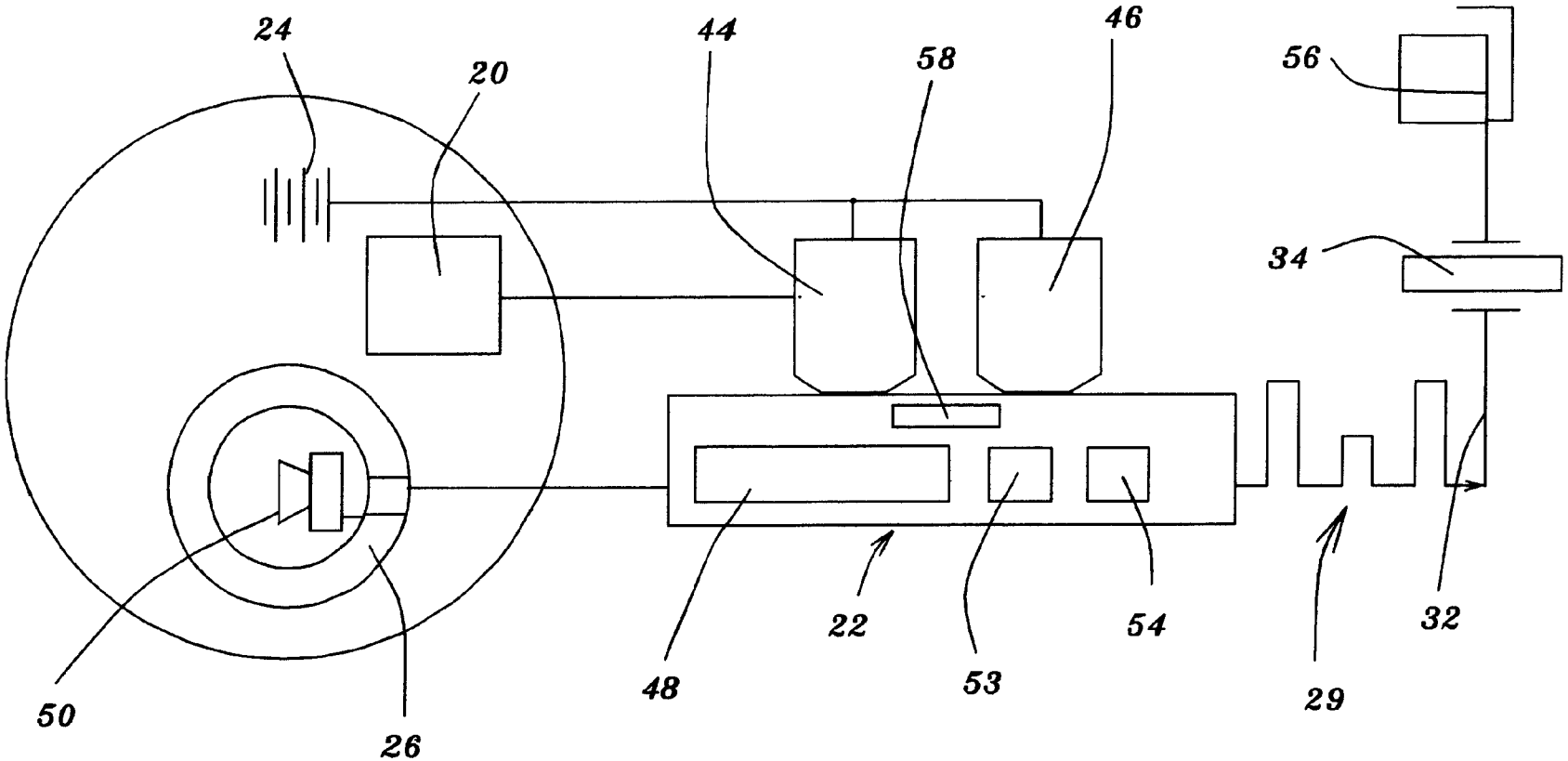
FIG. 4 is a schematic diagram showing in more detail, a micro controller shown in FIG. 3.

FIG. 4 is a schematic diagram showing the micro controller 22 in more detail. As shown in FIG. 4, the controller 22 further includes an activating circuit 48 for activating the controller 22 only when the detecting device 20 detects a hazardous condition so that in the absence of a hazardous condition, energy consumption and the power drain from the source of power 24 is minimized. Accordingly, the VDD requirements are only in the order of 2 volts with a 0.25 volt granularity.

Also, the electrical power source 24 is a direct current source which is preferably a 9 volt battery.

The alarm 26 includes an audible warning device 50 for emitting an audible warning signal. However, alternatively, as shown in FIGS. 3–4, the alarm 26 includes a visual warning device 52 for emitting a visual warning signal.

The digital signal 29 is easily transmitted over a considerable distance within the building 15 while minimizing a power drain from the source of electrical power 24.

Also, as shown in FIG. 4, the detector apparatus 10 further includes a surface mount dual amplifier 53 for amplifying the digital signal connected to the analog to digital converter 28 and to the controller 22 for transmitting the digital signal 29.

Additionally, as shown in FIG. 3, the receiver 30 further includes an amplifying circuit 53 for amplifying the detected digital signal and for applying the amplified signal to the warning alarm 26.

Moreover, each of the detectors 16–18 includes a discriminator circuit 58 programmed into the micro controller as shown in FIG. 4, for determining which detector of the plurality of detectors 16–18 is detecting the presence of a hazardous condition so that location of the source of the potential hazard is facilitated by increasing the pulse tone noise so that such speeds up the tone only on the detector that originally detected the smoke or the like while all the other detectors respond with a slower pulse tone.

Furthermore, each of the detectors 16–18 is free of any need for electrical hardwired connections to another detector of the plurality of detectors 16–18.

Also, each of the detectors 16–18 is free of any requirement of connection to an electrical outlet of a source of mains power within the building 15 thereby avoiding the need for locating each detector close to an electrical outlet.

In operation of the hazardous condition detector apparatus according to the present invention, the detecting device is sensitive to carbon monoxide or any combustible or heavier than air combustible gas. The detectors include a trip alarm disposed remote from the detectors for activating all the detectors in the building. Also, the apparatus includes for example a two minute false alarm setting for false hazardous condition situations such as caused by smoke from a cigar or cigarette so that all the alarms are not triggered. Additionally, the apparatus envisages a low battery alarm system to warn an occupant of the need to replace a battery. Such low battery system would not trigger the remaining detectors throughout the building.

The term "hazardous condition" used throughout the present application is to be understood to include the presence of carbon monoxide, smoke, abnormal heat or radiation or fire or any combination of these conditions.

The detector apparatus according to the present invention provides a unique system for conserving use of the power source while providing a reliable means for warning occupants of a potential hazard anywhere in the building.

What is claimed is:

1. A detector apparatus for emitting a warning alarm signal in response to the presence of a hazardous condition within at least one room of a building having a plurality of rooms, said apparatus comprising:

a plurality of detectors arranged such that at least one detector is disposed within a respective room for detecting the hazardous condition;

each of said detectors including:

a detecting device for detecting the presence of the hazardous condition;

a micro controller electrically connected to said detecting device and powered by an electrical power source;

an alarm electrically connected to said controller such that when said detecting device detects the presence of the hazardous condition, said controller emits an electrical signal;

an analog to digital converter device electrically connected to said controller for converting said electrical signal into a digital signal so that when the hazardous condition is detected, said converter transmits said digital signal;

a receiver for receiving said digital signal;

said receiver including:

an antenna for receiving said digital signal; and a crystal for detecting said digital signal and for using said detected digital signal to activate said alarm so that said alarm emits the warning alarm signal, the arrangement being such that each of said detectors of said plurality of detectors is disposed remote relative to each other within a respective room of the building so that when the hazardous condition is detected by one of said detectors, all of said detectors emit warning alarm signals for warning occupants within any of the rooms of a potential hazard within at least one of the rooms.

2. A detector apparatus as set forth in claim 1 wherein said detecting device includes:

a radiation source having an optical axis;

a photodetector having a further axis;

said further axis intersecting said optical axis of said radiation source for detecting radiation scattered by smoke particles.

3. A detector apparatus as set forth in claim 1 wherein said controller further includes:

an activating circuit for activating said controller only when said detecting device detects a hazardous condition so that in the absence of a hazardous condition, energy consumption and power drain from the source of power is minimized.

4. A detector apparatus as set forth in claim 1 wherein the electrical power source is a direct current source.

5. A detector apparatus as set forth in claim 4 wherein said direct current source is a 9 volt battery.

6. A detector apparatus as set forth in claim 1 wherein said alarm includes:

an audible warning device for emitting an audible warning signal.

7. A detector apparatus as set forth in claim 1 wherein said alarm includes:

a visual warning device for emitting a visual warning signal.

8. A detector apparatus as set forth in claim 1 wherein said digital signal is easily transmitted over a considerable distance within the building while minimizing a power drain from the source of electrical power.

9. A detector apparatus as set forth in claim 1 further including:

an amplifier for amplifying said digital signal.

10. A detector apparatus as set forth in claim 1 further including:

a transmitter connected to said analog to digital converter and to said controller for transmitting said digital signal.

11. A detector apparatus as set forth in claim 1 wherein said receiver further includes:

an amplifying circuit for amplifying said detected digital signal and for applying said amplified signal to said warning alarm.

12. A detector apparatus as set forth in claim 1 wherein each of said detectors includes:

a discriminator circuit for determining which detector of said plurality of detectors is detecting the presence of a hazardous condition so that location of the source of the potential hazard is facilitated.

13. A detector apparatus as set forth in claim 1 wherein each of said detectors is free of any need for electrical hard wire connections to another detector of said plurality of detectors.

14. A detector apparatus as set forth in claim 1 wherein each of said detectors is free of any requirement of connection to an electrical outlet of a source of mains power within the building thereby avoiding the need for locating each detector close to an electrical outlet.

15. A fire detector apparatus for emitting a warning alarm signal in response to the presence of smoke within at least one room of a building having a plurality of rooms, said apparatus comprising:

a plurality of smoke detectors arranged such that at least one detector is disposed within a respective room;

each of said detectors including:

a detecting device for detecting the presence of smoke;

a micro controller electrically connected to said detecting device and powered by an electrical power source;

an alarm electrically connected to said controller such that when said detecting device detects the presence of smoke, said controller emits an electrical signal;

an analog to digital converter device electrically connected to said controller for converting said electrical signal into a digital signal so that when smoke is detected, said converter transmits said digital signal;

a receiver for receiving said digital signal;

said receiver including:

an antenna for receiving said digital signal; and a crystal for detecting said digital signal and for using said detected digital signal to activate said alarm so that said alarm emits the warning alarm signal, the arrangement being such that each of said detectors of said plurality of detectors is disposed remote relative to each other within a respective room of the building so that when smoke is detected by one of said detectors, all of said detectors emit warning alarm signals for warning occupants within any of the rooms of a potential fire hazard within at least one of the rooms.

16. A fire detector apparatus for emitting a warning alarm signal in response to the presence of smoke within at least one room of a building having a plurality of rooms, said apparatus comprising:

a plurality of smoke detectors arranged such that at least one detector is disposed within a respective room;

each of said detectors including:

a detecting device for detecting the presence of smoke;

a micro controller electrically connected to said detecting device and powered by an electrical power source;

an alarm electrically connected to said controller such that when said detecting device detects the presence of smoke, said controller emits an electrical signal;

an analog to digital converter device electrically connected to said controller for converting said electrical signal into a digital signal so that when smoke is detected, said converter transmits said digital signal;

a receiver for receiving said digital signal;

said receiver including:

an antenna for receiving said digital signal;

a crystal for detecting said digital signal and for using said detected digital signal to activate said alarm so that said alarm emits the warning alarm signal, the arrangement being such that each of said detectors of said plurality of detectors is disposed remote relative to each other within a respective room of the building so that when smoke is detected by one of said detectors, all of said detectors emit warning alarm signals for warning occupants within any of the rooms of a potential fire hazard within at least one of the rooms; and each of said detectors is free of any need for electrical hard wire connections to another detector of said plurality of detectors.

* * * * *